United States Patent [19]

Diehl et al.

[11] 4,103,275

[45] Jul. 25, 1978

[54] RESISTANCE ELEMENT FOR RESISTANCE THERMOMETER AND PROCESS FOR ITS MANUFACTURING

[75] Inventors: Walter Diehl, Hanau; Wolfgang Koehler, Hörstein, both of Fed. Rep. of Germany

[73] Assignee: Deutsche Gold- und Silber-Scheideanstalt vormals Roessler, Frankfurt, Fed. Rep. of Germany

[21] Appl. No.: 659,144

[22] Filed: Feb. 18, 1976

[30] Foreign Application Priority Data

Feb. 22, 1975 [DE] Fed. Rep. of Germany ..... 2507731

[51] Int. Cl.[2] ..... H01C 3/04

[52] U.S. Cl. ..... 338/25; 338/28; 338/226; 338/307; 338/314; 252/514; 427/123

[58] Field of Search ..... 338/226, 314, 307, 28, 338/25; 204/192 F; 427/123; 252/514

[56] References Cited

U.S. PATENT DOCUMENTS

| | | | |
|---|---|---|---|
| 2,021,661 | 11/1935 | Kisfaludy | 204/192 F X |
| 2,292,065 | 8/1942 | Elsey | 427/123 X |
| 2,820,727 | 1/1958 | Grattidge | 427/123 X |
| 3,334,322 | 8/1967 | Bales | 338/28 |
| 3,356,982 | 12/1967 | Solow | 338/314 X |
| 3,407,081 | 10/1968 | Ballard | 252/514 X |
| 3,694,789 | 9/1972 | Brown | 338/28 X |
| 3,701,884 | 10/1972 | Finney | 338/22 R X |
| 3,703,456 | 11/1972 | Cordes | 204/192 F |
| 3,833,410 | 9/1974 | Ang et al. | 204/192 F X |
| 3,845,443 | 10/1974 | Fisher | 338/28 X |
| 4,050,052 | 9/1977 | Reichelt | 338/28 X |

OTHER PUBLICATIONS

*Journal of Applied Physics*, vol. 46, No. 2, Feb. 1975, pp. 558–567.

*Primary Examiner*—Benjamin R. Padgett
*Assistant Examiner*—E. Suzanne Parr
*Attorney, Agent, or Firm*—Cushman, Darby & Cushman

[57] ABSTRACT

There is provided a means for measuring resistance for a resistance thermometer consisting of an insulating former as a carrier and a thin platinum layer as resistance material, the carrier for the platinum layer being made of a material having a greater thermal coefficient of expansion than platinum over the range between 0° and 1000° C.

32 Claims, 2 Drawing Figures

RESISTANCE ELEMENT FOR RESISTANCE THERMOMETER AND PROCESS FOR ITS MANUFACTURING

The invention concerns a means for measuring resistance for a resistance thermometer consisting of an insulating former or member as carrier and a thin platinum layer, preferably in meander form, as resistance material and a process for the production of these resistance elements.

In the customary resistance elements for resistance thermometers thin wires or ribbons of metal, such as nickel or platinum, which have a definite resistance value and a high, uniform temperature coefficient of the electrical resistance (TCR) are put on an electrically non-conducting carrier or are embedded therein.

If higher demands are placed on such resistance elements in regard to preciseness and use at high temperatures, there is generally employed platinum as the resistance material. The resistance value at 0° C ($R_0$) and the temperature coefficient of the electrical resistance between 0° and 100° C of this platinum resistance element is standardized in substantially all industrial countries, in Germany, for example, by DIN 43760 (German Industrial Standard 43760).

In this standard, the following values are fixed: $R_0 = (100 \pm 0.1)$ ohm and TCR $=(3.85 \pm 0.012) \times 10^{-3} \times$ degree$^{-1}$. The corresponding standards of other countries require similar values.

These standards are already met by most resistance elements today, but the use of resistance thermometers equipped with platinum wires is limited in practice since they show various disadvantages for special uses. Thus, such resistance elements, for example, have relatively long response times and are not producible below a certain size, since a certain wire length is necessary for the $R_0$ value.

Therefore, in the past, there have been many attempts to use the thinnest possible wires for resistance elements, yet there are encountered in the production of such thin wires technical difficulties in regard to subsequent processing and manufacturing costs.

Therefore, it has also been proposed to use resistance elements for resistance thermometers in which a thin platinum layer is deposited on an electrically non-conductive support. Thus, for example in German Pat. No. 828,930 there is disclosed the application of thin platinum layers to non-conductive supports such as glass or ceramic by high vacuum vaporization or cathode sputtering, whereby the coating can cover either the entire surface of the support or only a portion thereof. From Fisher, German Offenlegungsschrift No. 2,327,662, it is further known to apply a high aluminum oxide containing glass with a thin platinum film embedded therein to a ceramic support. Likewise, it has been proposed (German Offenlegungsschrift No. 2,256,203) to apply a glass layer having platinum particles embedded therein to an electrically insulating support.

All of these known resistance elements having thin platinum coatings have the disadvantage that they do not reach the temperature coefficient of $3.85 \times 10^{-3} \times$ degree$^{-1}$ of the German Industrial Standard, but in most cases fall considerably below. Until now, therefore, such resistance elements are hardly used in practice.

Therefore, it was the problem of the present invention to provide resistance elements for resistance thermometers which have a short response time, are also producible in small dimensions without special expense and, above all, have a TCR between 0° and 100° C of at least $3.85 \times 10^{-3}$ degree$^{-1}$.

This problem is solved by the invention due to the application of resistance elements consisting of an insulating former as support and a thin platinum layer as resistance material wherein as the support for the platinum layer there must be used a material which has a greater thermal coefficient of expansion between 0° and 1000° C than platinum.

Especially approved as support is magnesium oxide whose thermal coefficient of expansion is $12 \times 10^{-6} \times$ degree$^{-1}$ while platinum has a corresponding value of $9.3 \times 10^{-6} \times$ degree$^{-1}$. Besides magnesium oxide there can be used as supports, for example, various heat resistant nickel alloys, such as Inconel, with an insulating coating. As thin insulating coating there can be used, for example, magnesium oxide, aluminum oxide or a silicate glass, e.g., a soda-lime silicate glass.

It is known that the temperature coefficient of the electrical resistance of a thin layer does not reach that of the bulk material which is explained partially by the electron scattering on the surface of the layer and on the grain boundaries. It was, therefore, the more surprising that by using a support of the invention whose thermal coefficient of expansion is greater than that of platinum between 0° and 1000° C., thin platinum coatings reach the TCR of the electrical resistance of pure solid platinum.

The production of resistance elements according to the invention is known in principle from microelectronics through the so-called thin film technique used in the manufacture of integrated switching networks. By sputtering (cathode sputtering) or vacuum vaporization there is placed a platinum layer having a thickness of 1 to 10 microns on the insulating support. For the production of meander designs the platinum film is then coated, for example, with a photosensitive lacquer and the desired structure produced on this by partial covering, exposure to light and development. The desired conductor path then can be produced by ionic etching or other processes. In this way, there are producible conductor paths up to a width of about 2.5 microns. The adjustment of these conductor paths to a fixed $R_0$ value is likewise known from microelectronics and, preferably, takes place be means of a laser beam.

There are produced especially high temperature coefficients of the electrical resistance if the thin platinum layer is produced by sputtering in an oxygen containing atmosphere. There has been found particularly valuable an argon oxygen mixture in which the oxygen content is preferably 5 to 60 volume %. However, there are also usable other noble gas-oxygen mixtures. Among other suitable noble gases are helium and neon. The layer applied by sputtering or vaporization must be subsequently tempered at temperatures above 800° C., preferably in the range of 1000° to 1200° C., to reach a maximum grain growth which again is a prerequisite for a high TCR.

The resistance element of the invention can be worked up into a resistance thermometer in known manner, thus, for example, by insertion in a suitable protective tube.

Figure 1:
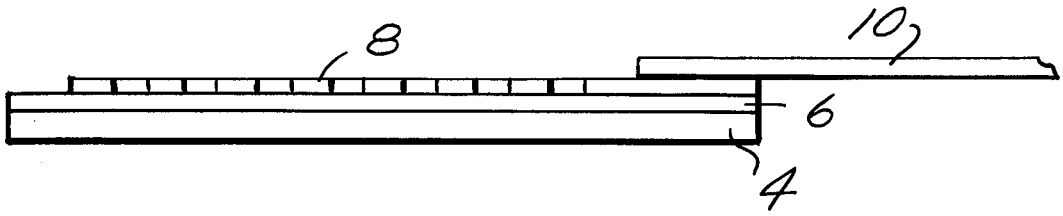
FIG. 1 is a side elevation.
Figure 2:
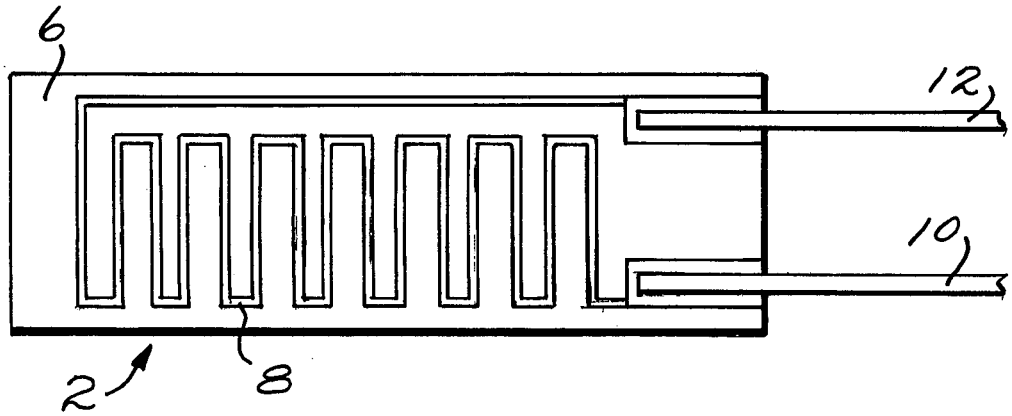
FIG. 2 is a top plan view of the resistance element of the invention.

Referring more specifically to the drawings the resistance element designated generically at 2 comprises an Inconel sheet support 4 having an insulating coating 6 of magnesium oxide having a conductor path 8 of platinum thereon. The terminal wires are shown at 10 and 12.

Unless otherwise indicated, all parts and percentages are by weight.

The following examples further explain the invention.

EXAMPLE 1

Using a commercial sputtering apparatures with an argon oxygen mixture, containing 17% oxygen under a operating pressure of $6 \times 10^{-3}$ torr, we exposed flat magnesium oxide plates of 20 × 20 mm onto which a platinum layer of 4.2 microns was sputtered. The high frequency output was 1100 watts, the applied voltage 2600 volts and the backlash voltage (bias) 100 volts. The platinum layer was subsequently tempered for 3 hours at 1000° C. in air; meanders were produced by photoresist technique: the platinum film is coated with a photosensitive lacquer, and the desired structure on this lacquer is produced by partial covering it with a mask, exposure to light through this mask and development. The desired conductor path in the platinum layer then is produced by ion etching. ("sputteretching"), the parts of unremoved photosensitive laquer preventing the platinum covered by them from being etched off. The measured temperature coefficient of the electrical resistance was $(3.86 \pm 0.01) \times 10^{-3} \times \text{degree}^{-1}$.

EXAMPLE 2

Using the apparatus and conditions of example 1 there was applied by sputtering to an Inconel sheet (80 Ni, 14 Cr, 6 Fe) measuring 20 mm × 20 mm and previously coated with about 10 microns magnesium oxide, a platinum layer having a thickness of 6.3 microns in an argon-oxygen-mixture containing 50 volume % of oxygen and an operating pressure of $8 \times 10^{-3}$ torr. After the tempering (2 hours, 1050° C) and production of the meanders, there was measured a TCR of $(3.89 \pm 0.01) \times 10^{-3} \times \text{degree}^{-1}$.

What is claimed is:

1. A resistance element for a resistance thermometer consisting essentially of an insulating body as a support and a thin platinum layer thereon as the resistance material, said support being made of a material having a greater thermal coefficient of expansion greater than platinum between the range of 0° to 1000° C.

2. A resistance element according to claim 1 wherein the support comprises magnesium oxide.

3. A resistance element according to claim 1 wherein the platinum layer has a thickness of 1 to 10 microns.

4. A resistance thermometer including the resistance element of claim 1.

5. A resistance thermometer according to claim 4 wherein the support consists essentially of magnesium oxide.

6. A resistance thermometer according to claim 4 comprising the resistance element in a protective tube.

7. A resistance element according to claim 1 having a TCR of $3.85 \times 10^{-3}$.

8. A resistance thermometer including the resistance element of claim 7.

9. A resistance element according to claim 7 wherein the support is made of a nickel alloy with an insulating coating.

10. A resistance element according to claim 1 wherein the support is made of a nickel alloy, with an insulating coating.

11. A resistance element according to claim 10 wherein the insulating coating consists of magnesium oxide, aluminum oxide or a silicate glass.

12. A resistance element according to claim 10 wherein the insulating coating consists of magnesium oxide or aluminum oxide.

13. A resistance element according to claim 12 wherein the insulating coating consists of magnesium oxide.

14. A resistance element according to claim 10 wherein the nickel alloy is a nickel, chromium, iron alloy.

15. A resistance element according to claim 14 wherein the alloy is 80 Ni, 14 Cr, 6 Fe.

16. A resistance element according to claim 15 wherein the insulating coating consists of magnesium oxide, aluminum oxide or a silicate glass.

17. A resistance element according to claim 16 wherein the insulating coating consists of magnesium oxide or aluminum oxide.

18. A resistance element according to claim 17 wherein the insulating coating consists of magnesium oxide.

19. A resistance element according to claim 15 having a TCR of $3.85 \times 10^{-3}$.

20. A process of producing the resistance element of claim 19 comprising applying the thin platinum layer to the support by cathode sputtering in an oxygen containing atmosphere and thereafter tempering at a temperature above 800° C.

21. The process of claim 20 wherein the oxygen containing atmosphere consists essentially of oxygen and an inert gas.

22. The process of claim 21 wherein the atmosphere consists of an argon-oxygen mixture.

23. The process of claim 21 wherein the tempering is at a temperature up to 1200° C.

24. The process of claim 21 wherein the oxygen content of the atmosphere is 5 to 60 volume %, the balance being inert gas.

25. The process of claim 24 wherein the inert gas is argon.

26. The process of claim 25 wherein the tempering is at 1000° to 1200° C.

27. The process of claim 26 wherein the insulating coating comprises magnesium oxide.

28. A process according to claim 20 wherein the support is made of a nickel alloy having an insulating coating comprising magnesium oxide, aluminum oxide or a silicate glass.

29. A process according to claim 28 wherein the nickel alloy is a nickel, chromium, iron alloy.

30. A process according to claim 28 wherein the insulating coating comprises magnesium oxide.

31. A resistance element according to claim 29 wherein the insulating coating comprises magnesium oxide or aluminum oxide.

32. A resistance element according to claim 31 wherein the insulating coating comprises magnesium oxide.

* * * * *